US005603423A

United States Patent [19]

Lynn et al.

[11] Patent Number: 5,603,423

[45] Date of Patent: Feb. 18, 1997

[54] PLASTIC CONTAINER FOR CARBONATED BEVERAGES

[75] Inventors: Stephen R. Lynn, Douglasville; William J. Peek, Lithonia, both of Ga.

[73] Assignee: Ball Corporation, Muncie, Ind.

[21] Appl. No.: 431,532

[22] Filed: May 1, 1995

[51] Int. Cl.[6] ..... B05D 1/42

[52] U.S. Cl. ..... 215/375; 220/606

[58] Field of Search ..... 215/375, 374; 220/606, 608

[56] References Cited

U.S. PATENT DOCUMENTS

| | | | |
|---|---|---|---|
| D. 327,845 | 7/1992 | Behm et al. . | |
| D. 330,330 | 10/1992 | Behm et al. . | |
| 3,598,270 | 8/1971 | Adomaitis et al. . | |
| 3,935,955 | 2/1976 | Das | 215/375 |
| 4,249,666 | 2/1981 | Hubert et al. . | |
| 4,249,667 | 2/1981 | Pocock et al. . | |
| 4,318,489 | 3/1982 | Snyder et al. . | |
| 4,335,821 | 6/1982 | Collette et al. . | |
| 4,785,950 | 11/1988 | Miller et al. . | |
| 4,865,206 | 9/1989 | Behm et al. . | |
| 4,978,015 | 12/1990 | Walker . | |
| 5,024,339 | 6/1991 | Reimer | 215/375 |
| 5,024,340 | 6/1991 | Alberghini et al. . | |
| 5,064,080 | 11/1991 | Young et al. . | |
| 5,133,468 | 7/1992 | Brunson et al. . | |
| 5,205,434 | 4/1993 | Brunson et al. . | |
| 5,320,230 | 6/1994 | Hsiung . | |
| 5,353,954 | 10/1994 | Steward et al. . | |

*Primary Examiner*—Allan N. Shoap
*Assistant Examiner*—Christopher J. McDonald
*Attorney, Agent, or Firm*—Gilbert E. Alberding

[57] ABSTRACT

A plastic container comprises a lower base-forming portion that includes a plurality of circumferentially-spaced, generally spherically-shaped segments and a plurality of intervening, circumferentially-spaced, totally convex, hollow foot-forming portions that extend radially from the central bottom portion and downwardly from the spherically-shaped segments to form a clearance for the central bottom portion. The clearance-forming portion of each foot-forming bottom portion includes a compound curved offset formed with opposing radii of curvature of a substantial fraction of an inch, the compound curved offset curving downwardly and outwardly about a center of curvature below the bottom-forming portion before curving about a center of curvature above the bottom-forming portion. Each bottom clearance-forming portion further includes a spherical surface curving downwardly and outwardly from the central bottom portion and member into the compound curved offset and a lowermost substantially planar portion extending downwardly and outwardly from the compound curved offset for formation of one of the supporting feel.

23 Claims, 3 Drawing Sheets

PLASTIC CONTAINER FOR CARBONATED BEVERAGES

FIELD OF THE INVENTION

This invention relates to plastic containers for fluids under pressure, such as carbonated soft drinks, beer and the like. More particularly, this invention relates to a plastic bottle for carbonated beverages including a durable bottom providing a stable container and resistance to distention, crazing and stress cracking.

BACKGROUND OF THE INVENTION

Plastic containers that can reliably contain carbonated beverages generating internal pressures as high as 100 psi or more and that can be inexpensively manufactured in attractive shapes pose a technical problem that has received substantial attention by those working in this art.

The spherical shape, which has the greatest ratio of volume to surface area, provides an optimum uniform distribution of wall stresses generated by internal pressures and thus achieves the maximum reliable and effective strength for a given wall material thickness, and, indeed, internal pressures within non-spherically-shaped containers tend to urge the non-spherically-shaped containers toward a spherical shape. A spherical shape is, however, unacceptable as a commercial beverage container because, among other obvious reasons, a sphere has no stable base and cannot effectively use shelf and storage space of retail and wholesale purveyors and manufacturers.

Workers in the art have sought to develop cylindrical plastic beverage containers that can reliably and attractively contain carbonated beverage products, can be inexpensively manufactured, and have stability when filled and unfilled, and an extensive variety of container designs have been developed by those working in the art to meet these needs.

Such containers have most frequently been manufactured from plastic materials such as polyethylene terephthalate (PET) by, for example, blow molding a parison of PET into a mold formed in the shape of the container. The biaxial expansion of PET by blow molding imparts rigidity and strength to the formed PET material, and blow molded PET can provide economically acceptable wall thicknesses, an attractive container with clarity in relatively intricate designs, sufficient strength to contain pressures up to 100 psi and more, and resistance to gas passage that may deplete contained beverages of their carbonation.

One factor that is, however, frequently over looked in container designs of those working in the art is the propensity of PET to succumb to the deleterious effects of stress cracking and crazing, which is manifest as almost imperceptible streaks in the plastic but ultimately can become complete cracks due to stress and other environmental factors. Relatively unstretched portions of a plastic container that have low degrees of crystallinity due to the lack of biaxial expansion, such as the central bottom portion, are particularly susceptible to crazing and stress-cracking. The relatively unstretched central portion of the container bottom is also frequently provided with a plurality of depending feet that are formed with distention-resistant but stress concentrating areas, and the composite effect on such areas of stress and strain due to the internal pressure of the container and external environmental factors, such as exposure to stress cracking agents, (e.g., caustics, water, oils and generally any plastic solvent or softening agent) can lead to crazing, stress-cracking and container bottom failure.

One commercial cylindrical beverage container that seeks to avoid such problems is formed with a full hemispherical bottom portion and provided with a separate plastic base member fastened over the hemispherical bottom portion to provide a stable base for the container. Such containers are in common use for large multi-liter containers for carbonated beverages, even though the provision of a separate plastic base member imposes increased manufacturing and material costs on the cost of each container. Offsetting somewhat the increased costs imposed by the addition of a separate base piece, is the fact that use of a hemispherical bottom portion can permit a reduction in the bottom wall thickness, tending to maximize the containable pressure for a given wall thickness in the bottom portion and reducing the cost of the plastic material in the container portion.

Those working in the art have also generated commercial containers including "champagne" type bases including concave, or "domed" eversion-resisting central bottom portions merging with the cylindrical container sidewalls at an annular ring which forms a stable base for the container. The central domed portion of a champagne-based plastic container generally creates clearance for the gate area of the container which is intended to resist deformation due to the internal pressure of the container but is sensitive to stress cracking. Unfortunately, containers with champagne bases require a greater wall thickness in the base portion to resist the distending and everting forces of the internal pressure and form stress concentrations at the annular base-forming transition between the concave central bottom portion and cylindrical sidewall that are prone to stress cracking and rupture when the container is dropped. One container design addressing this problem is disclosed in U.S. Pat. No. 4,249,666.

Notwithstanding their champagne bases, it is not uncommon, however, particularly during hot summer months, for the bottoms of such commercial containers to distend and increase the internal volume enough to significantly lower the fluid level, creating an unacceptable product presentation to the consumer, and in some cases to expand beyond their intended bases, creating unstable and unacceptable "rockers".

More recently, the use of hemispherical bottom portions and concave champagne-like bottom portions have been combined by workers in the art in designs in which a plurality of feet are formed in the bottom of a blow molded container. These designs frequently seek eversion-resistant concave central bottom portions formed by a plurality of surrounding feet that are interconnected by a plurality of generally convex hemispheric rib portions. Some such container designs providing footed bottles are in commercial usage, particularly in smaller containers for carbonated beverages such as those containing a liter or less.

Such container designs, however, are still subject, in the absence of relatively thick bottom wall portions, to distention of their concave central portions due to high internal pressures that can create "rockers" and significantly increased interior container volume with lower fluid levels, all of which are unacceptable to purchasers. Efforts to increase the eversion and distention resistance of the concave bottom portions of such footed containers with thinner bottom wall thicknesses have frequently led to bottom portions including small radii of curvature and discontinuous and abrupt transitions between adjoining surfaces that provide stress concentration, crazing and stress cracking sites. Some container designs, for example, those of U.S. Pat. Nos. 4,865,206 and 5,353,954, have addressed the problem of stress concentration, stress cracking and impact resistance. None of these container designs is entirely satisfactory in view of cost, manufacturability and reliability.

SUMMARY OF THE INVENTION

The invention provides a plastic container for carbonated beverages with low cost and weight because of ease of manufacturing from plastic material by blow molding and minimal plastic material in its walls, with excellent stability in both filled and unfilled conditions because of its wide foot span and its resistance to distention of its bottom portion and with durability because of its freedom from destructively high stress concentrations, crazing and stress cracking.

A plastic container of the invention comprises an upper mouth-forming portion, a cylindrical sidewall portion and a lower bottom-forming portion that includes a plurality of circumferentially-spaced, generally spherically-shaped segments extending downwardly from the cylindrical sidewall and a plurality of intervening, circumferentially-spaced, totally convex, hollow foot-forming portions that extend radially from the central bottom portion and downwardly from the hemispherically-shaped segments to form a clearance for a concave central bottom portion. The clearance-forming portions of the foot-forming bottom portions each include compound curved offsets formed with opposing radii of curvature of a substantial fraction of an inch, the compound curved offset curving downwardly and outwardly from the central bottom portion, about a center of curvature below the bottom-forming portion before curving about a center of curvature above the bottom-forming portion. Where the hollow foot-forming portions also expand circumferentially, the lowermost portions of the clearance-forming portions can provide substantially planar portions adjacent the supporting feet.

One container embodiment of the invention can comprise, in combination with a plastic container including a cylindrical sidewall and an upper mouth-forming portion, a spherical bottom portion including a plurality of totally convex, hollow foot-forming portions extending radially, circumferentially and downwardly from the spherical bottom portion to form supporting feet adjacent the periphery of the container. The totally convex, hollow foot-forming portions include saddle-shaped transitions formed between the supporting feet and the central spherical bottom portion and offsetting said supporting feet downwardly a substantial fraction of an inch.

A container of the invention can further comprise a base-forming lower portion including a central concave portion and a plurality of hollow feet formed about the central concave portion, the plurality of feet being formed by a plurality of totally convex, radially, circumferentially and downwardly extending bottom portions which each include a saddle-shaped, deflection-resisting transition, defined in cross-section coplanar with the container axis by an external radius of a substantial fraction of an inch that extends radially, circumferentially and downwardly from the central base portion and merges with a substantially planar portion extending radially, circumferentially and slightly downwardly to one of the feet to provide, in combination, a significantly stress-free, distention-resisting clearance of a substantial fraction of an inch between the central base portion and the container feet.

A blow molded base of the invention can include a plurality of circumferentially-spaced, spherically-shaped segments and a plurality of intervening and circumferentially-spaced hollow foot-forming portions, all extending radially outwardly from the central longitudinal axis of the base. The hollow foot-forming portions extend downwardly from the circumferentially-spaced, spherically-shaped segments and include clearance-forming portions, and each clearance-forming portion includes a compound curved offsetting transition which is formed, in a cross-sectional plane through the compound curved offsetting transition and coplanar with the central longitudinal axis, by a pair of opposing radii of a substantial fraction of an inch, and, in cross-sectional planes transversing the compound curved offsetting transition and lying generally orthogonal to the longitudinal axis and generally parallel to the hollow foot-forming portions, by curves formed by internal radii, extending within the foot-forming portions. In preferred bases of the invention, all internal radii of the hollow foot-forming portions are a substantial fraction of an inch.

In describing the invention, "totally convex" means that, as viewed from the exterior of the container, a surface is defined in its curved portion or portions by radii that extend from the interior surface of the container away from the eye of the observer, and such radii are referred to herein as "internal radii". "External radii", are, therefore, radii extending from the exterior surface of the container toward the eye of such an observer. "Opposing radii" means radii extending from opposite sides of a surface and defining tangent circles (i.e., a combination of an external and an internal radius that merge smoothly to form a compound curved surface).

Further embodiments, features and advantages of the invention will become apparent from the drawings and the following more detailed description of a preferred embodiment of the invention.

DETAILED DESCRIPTION OF THE DRAWINGS

DETAILED DESCRIPTION OF THE INVENTION

FIGS. 1–7B illustrate a presently preferred container 10 of this invention in the form of a plastic carbonated beverage bottle with a capacity of two liters. FIGS. 1–4 are drawn with a "wire frame" format to illustrate the structure of the invention.

Figure 1:
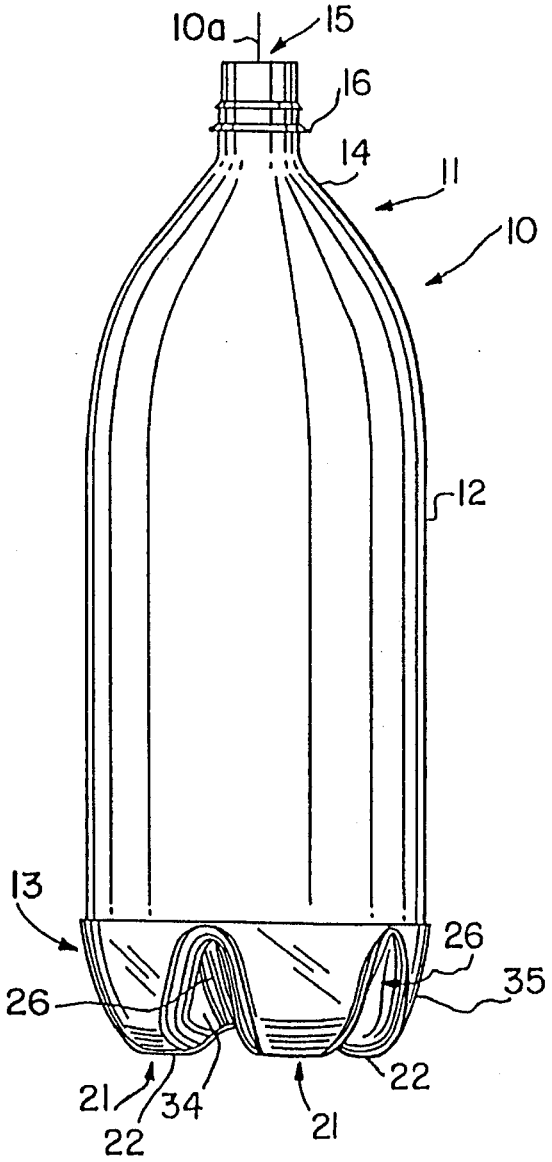
FIG. 1 is a side view of a container of the invention.
Figure 3:
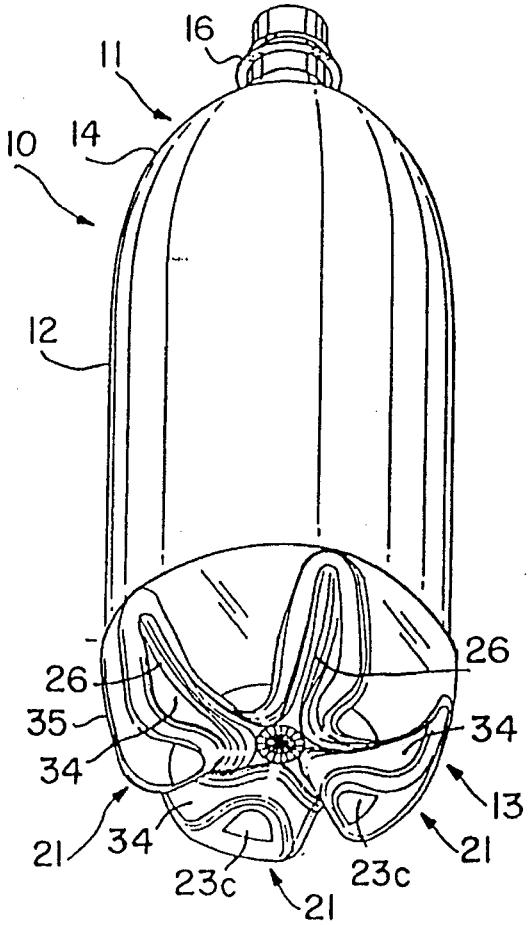
FIG. 3 is a perspective view of the container of FIGS. 1 and 2 from below the container to illustrate the container base of this invention.

As shown in FIGS. 1 and 3, such a container 10 includes an upper neck and mouth-forming portion 11, a cylindrical sidewall portion 12 extending around the longitudinal axis 10*a* of the container, and a lower base-forming portion 13. The upper portion 11 provides a neck-forming transition 14 leading to the container mouth 15. The transition portion 14 of a container of the invention may take any conveniently usable and moldable shape such as a frusto-conical, hemispherical, ogive or other shape as may be selected by a container designer. The finish 16 of the container adjacent the mouth 15 is shown as threaded to accept a threaded cap commonly used to close carbonated beverage bottles; however, the mouth-forming portions of containers of the invention may be provided with means to accommodate other closures than threaded closures, as apparent to those working in the art.

As shown in FIGS. 1–5 and 7A, the bottom portion 13 of the container 10 includes a central portion 20 and a plurality of foot-forming portions 21 formed about the central portion for supporting the container 10. The foot-forming portions 21 extend downwardly and are spaced between a plurality of convex, circumferentially-spaced, spherically-shaped segments 26 that extend downwardly from the cylindrical sidewall 12.

This invention resides in the lower base-forming portion 13 of the container and its bottom, as provided with a plurality of hollow foot-forming portions 21, providing a stable container base and bottom clearance and rigidity to maintain the container stability when unfilled or filled without occurence of stress concentrations, crazing and stress cracking.

Figure 4:
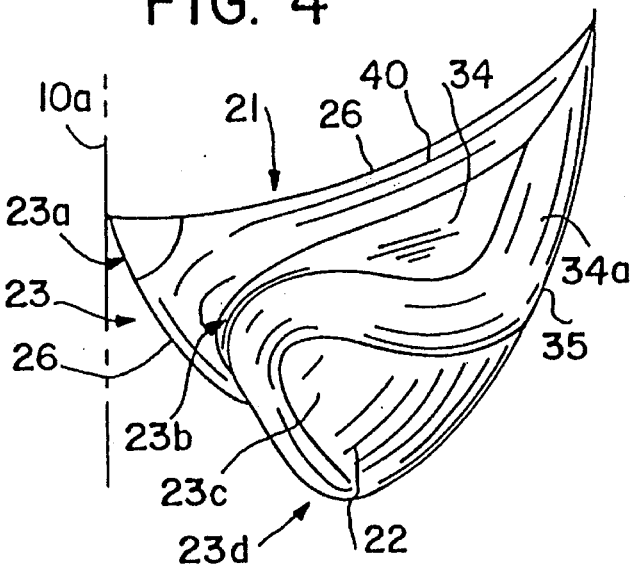
FIG. 4 is a partial perspective view from below of one foot-forming portion of the base of this invention as illustrated in FIGS. 1–3.
Figure 5:
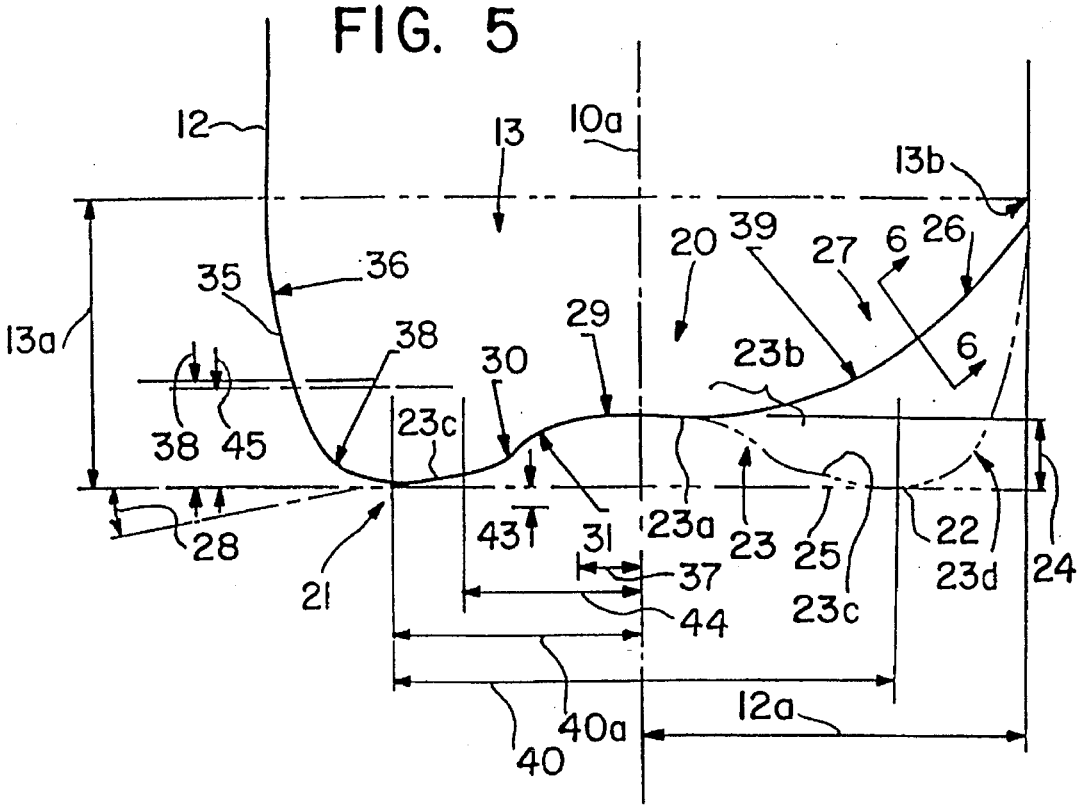
FIG. 5 is a cross-sectional view of the bottom of the container of FIGS. 1–4 taken at a plane coplanar with the longitudinal axis of the container and through the center of a foot-forming portion, as indicated by line 3—3 of FIG. 2.
Figure 7A:
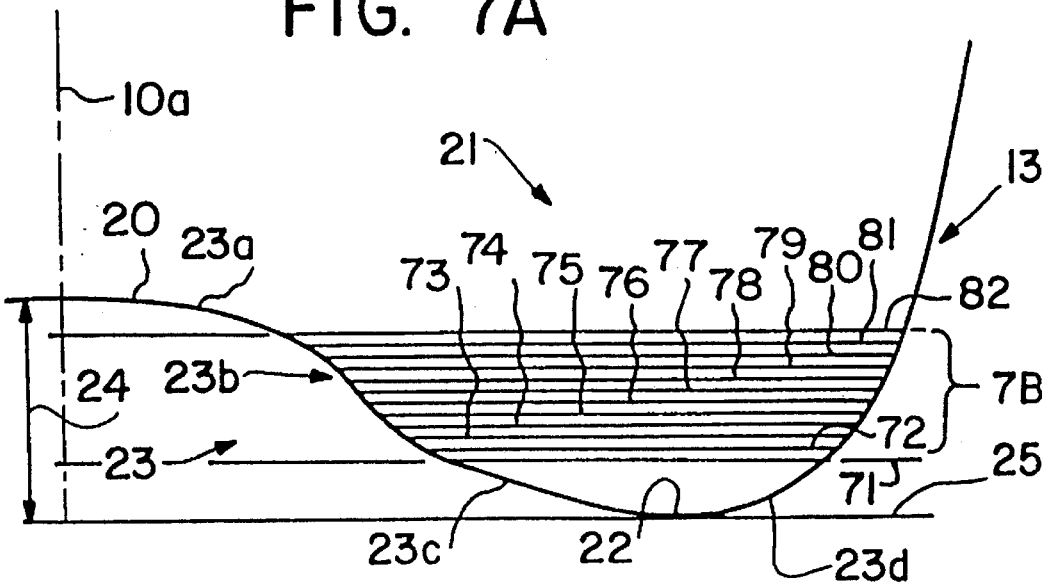
FIG. 7A is a cross-sectional view of a foot-forming portion of the containers of FIGS. 1–6 with a series of orthogonal cross-sectional planes 7B to further illustrate the foot-forming portion.
Figure 7B:
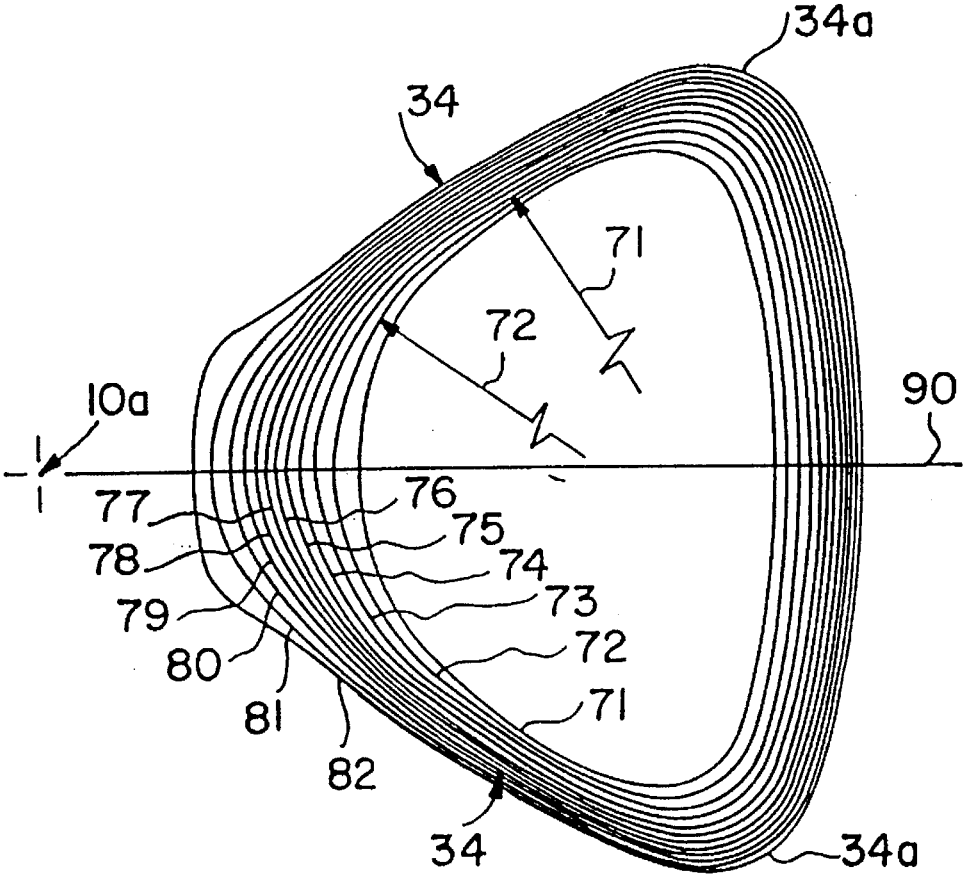
FIG. 7B comprises a series of cross-sections taken orthogonal to FIG. 7A at the series of planes 7B.

Foot-forming portions 21 of containers of the invention are shown in greater detail in the cross-sectional drawing of FIG. 5, the perspective drawing of FIG. 4, and the cross-sectional drawings FIGS. 7A and 7B. Each foot-forming portion 21 includes a clearance-forming portion 23 extending from the longitudinal axis 10*a* of the container to adjacent each of the supporting feet 22. As described in greater detail below and as shown in FIGS. 3–5, the clearance-forming portion 23 of each foot-forming portion 21 provides a substantial clearance height 24 between the central portion 20 of the container bottom and the plane 25 of the supporting feet 22 and includes a distention resistant, compound curved offset 23*b* formed with opposing radii of curvature and curving downwardly and outwardly first about a center of curvature 31 below, and then about a center of curvature 30 above, the compound curved intermediate portion 23*b* to contribute a substantial portion (e.g., 30 to 50 percent) of the clearance height.

As more clearly shown in FIG. 4 and the cross-section of FIG. 5, a preferable clearance forming portion 23 of foot-forming portion 21, in extending radially and downwardly from the central longitudinal axis 10*a*, comprises three contiguous regions along its lowermost surface. The three lowermost regions are a slightly downwardly curved, central, spherical portion 23*a* centered on the longitudinal axis 10*a*, the compound curved offset 23*b*, and an outermost, and a lowermost slightly descending portion 23*c* extending outwardly from the compound curved offset portion 23*b* to a supporting foot 22 and merging into an outer curved portion 23*d* extending from the supporting foot 22 upwardly and outwardly toward the container sidewall 12.

As shown best in FIGS. 5 and 7A, clearance 24 is provided by the descending surface portions 23*a* and 23*c* and the offset ramp-like intermediate portion 23*b*. In this preferred container of the invention, the angle of descent 28 (FIG. 5) of clearance-forming portions 23*c* is preferably about 10° to 15°, although other angles of descent may be used in the invention depending upon the diameter of the container, the internal pressure to be contained and the bottom clearance required. As shown in FIG. 5, compound curved offset portion 23*b* is preferably formed with opposing radii of curvature 30 and 31 of a substantial fraction of an inch. A "substantial fraction of an inch", as used in this application, means from about 0.1 inch to about 0.6 inch. In containers of the invention, the offset portion 23*b* between central portion 23*a* and portion 23*c* can contribute a substantial fraction of an inch to, and a substantial portion of, the clearance distance 24 and can also contribute distention-resistance in the foot-forming portion 21 of the container. The outwardly and upwardly extending bottom surface portion 23*d* extending from the supporting feet 22 are also preferably formed with radii of curvature 38 of a substantial fraction of an inch.

Figure 2:
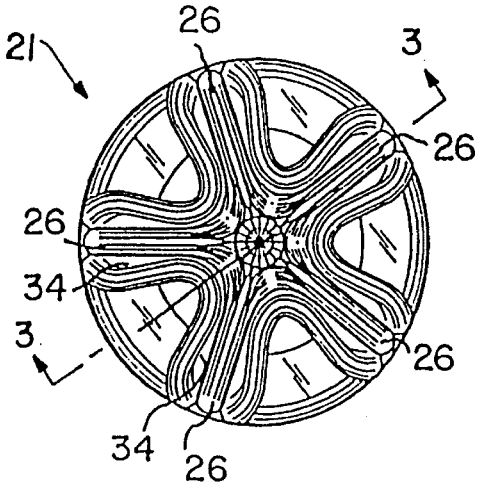
FIG. 2 is a bottom view of the container of FIG. 1.

As shown in FIGS. 2–4, 7A and 7B, each of the plurality of foot-forming portions 21 preferably extends radially, circumferentially and downwardly between the intervening, generally spherical segments 26 of a spherical bottom configuration 27. The surface portions indicated as 23*a*, 23*b*, 23*c* and 23*d* in the perspective view of FIG. 4 correspond to the four regions 23*a*, 23*b*, 23*c* and 23*d* of the cross-sections of FIGS. 5 and 7A. As shown in FIGS. 2–4, surface portions 23*c* are, preferably, substantially planar. "Substantially planar" portions of containers of this invention comprise those relatively flat wall portions having minimum radii of curvature of several times the radius of the cylindrical container sidewall in orthogonal directions.

Thus, as illustrated by the perspective view of FIG. 4, the foot-forming portions 21 of the invention (only one of which is illustrated in FIG. 4) preferably expand circumferentially as they extend radially outwardly and include saddle-shaped transitions extending downwardly a substantial fraction of an inch from the concave central spherical portion 23*a* to the substantially planar third portions 23*c* of their clearance-forming portions. The saddle-shaped transitions are preferably formed with an external radii 31 (FIG. 5) of a substantial fraction of an inch, and internal radii, in planes orthogonal to the longitudinal container axis, of at least a substantial fraction of an inch that extend through the interior of the foot-forming portions 21 toward their centers (see, for example, r71 and r72 of FIG. 7B). The saddle-shaped transitions curve smoothly into the substantially planar third portions 23*c*, with internal radii of curvature 30, and the saddle-shaped transitions, in combination with the curved transitions provide a substantial, distention resistant, offset of the central bottom portion 23*a*, and a substantial clearance height 24 between the feet 22 and the central bottom portion 23*a*.

As shown in FIGS. 1–4 and most clearly in FIG. 4, and as indicated in FIGS. 7A and 7B, the foot-forming portions 21 of the invention are totally convex. As illustrated in FIGS. 7A and 7B, at cross-sections taken at planes 71–82 through the foot-forming portions 21 and across the longitudinal axis 10*a* and parallel to the plane 25 of the feet 22, the walls of the foot-forming portion are formed by surfaces curving outwardly from the container interior about internal radii (e.g., r71 and r72) extending within the foot-forming portions 21 at each cross-section 71 through 82, and the walls thus form totally convex foot-forming portions (as can be seen from the perspective view of FIG. 4).

As indicated in FIGS. 1–4 and 6, the foot-forming portions 21 include substantially planar side panels 34 that blend into and join the spherical segments 26 of the container bottom. As indicated in FIGS. 1–4 and 7B, the outer surface portions 35 of foot-forming portions 21 are joined to the side panels 34 by curved transitions 34*a* that also preferably have a radius of curvature of substantial fraction of an inch. In addition, the outer surface portions 35 of the foot-forming portions 21 preferably have radii of curvature 36 in cross sections lying in planes coplanar with the longitudinal axis of the container substantially greater than the radius of the cylindrical sidewall 12, although surfaces 35 may be frusto-conical surfaces merging into the cylindrical sidewall with an appropriate radius of curvature.

Thus, containers of this invention can provide both good resistance against base movement and high resistance to crazing and stress cracking.

In containers of the invention, the radius of curvature 39 of the spherical bottom configuration 27 and spherical segments 26 may be equal to the radius of the cylindrical sidewalls 12 or may be, as shown, increased to provide a larger right circular cylindrical sidewall portion 12 of the container for the mounting of labels and other indicia.

In containers of the invention, the central bottom portion 20, that is, the uppermost bottom surface 23*a*, does not move axially downward to such a degree that it becomes a contact surface for the container, and the foot contact diameter 40 remains largely unchanged even when the central region of the container bottom is distended under pressurization. Because of the plurality of totally convex offset transition portions 23*b*, containers of the invention can provide a greater clearance distance 24 between the central portion 20 of the bottom and the plane 25 of the supporting feet 22, reducing further the tendency for the creation of "rocker" bottles. In containers of the invention, foot-forming portions 21 are totally convex walls, formed by an internal radii of substantial fraction of an inch, creating the offset transition portions 23*b* to significantly reduce stress concentration in this relatively unexpanded central area of the container bottom and provide the bottle with improved stress crack performance without a loss of stability.

EXAMPLE

In a carbonated beverage bottle for containing two liters, a plastic container of the invention will have an overall height of about 11.82 inches, for filling within about 2.10 inches of the mouth. A preferable finish 16 for a carbonated beverage bottle will comprise a threaded opening as shown in FIG. 1, with a PCO-28 finish. The right circular cylindrical sidewall 12 will have a diameter 12*a* of on the order of 4.28 inches, and the neck-forming transition 14 between the cylindrical sidewall and the bottle mouth 15 will be, as shown, an ogive shape extending downwardly from about an inch below the mouth 15 of the bottle to blend into the cylindrical sidewall 12 approximately 4.62 inches below the mouth 15. Where the radius of curvature 39 of the hemispherical bottom portions 26 equals about 2.6 inches and the clearance height 24 equals about 0.375 inches, the lower base-forming portion 13 of such a bottle can extend from the plane 25 of the supporting feet 22 upwardly a distance 13*a* about 1.54 inches. The resulting right circular cylindrical sidewall 12, after a small transition radius 13*b* of about 0.05 inches, is about 5.6 inches high for the affixation of labels and other indicia.

Figure 6:
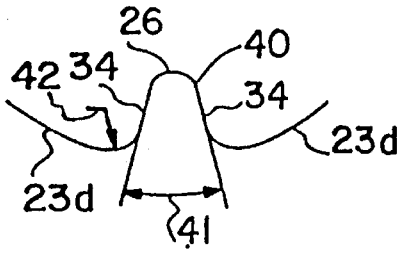
FIG. 6 is a partial cross-sectional view of a spherical segment of the container bottom of FIGS. 1–5 taken at the partial plane 6—6 of FIG. 5.

The radius of curvature 29 of the concave spherical central portion 23*a* of the foot-forming portion 21 can be about 1.913 inches. The downwardly descending lowermost portions 23*c* of the radially expanding foot-forming portion 21 form an angle 28 of about 10° to 15° with respect to the plane 25 of the supporting feet 21, and the opposing radii of curvature 30 and 31 are each be about 0.446 inch. The radius of curvature 31 extends from a center located below the bottom wall and outwardly a distance 37 of about 0.354 inch from central longitudinal axis 10*a* of the container and located a distance 43 about 0.115 inch below the plane 25 of its feet 22, and the radius of curvature 30 extends from a center located above the bottom wall and outwardly a distance 44 of about 0.983 inches from the enter longitudinal axis 10*a* of the container and located a distance 45 about 0.518 inches above the plane 25 of feet 22. The center of the radii of curvature 30 and 31 are thus located so that the offsetting transition surfaces formed thereby merge smoothly with the spherical surface portion 23*a* formed by the radius of curvature 29 and with the lowermost descending substantially planar surface portions 23*c*. Together, the surfaces formed by radii of curvature 30 and 31 offset the substantially planar surface 23*c* downwardly from surface formed by 23*a* about 0.147 inch which is a substantial fraction of an inch and a substantial portion, about 40 percent, of the 0.375 clearance distance 24. The supporting feet 22 lie on a diameter 40 of about 2.800 inches about the longitudinal axis 10*a* of the container and provide a stable support for the bottle. The radius of curvature 38 of the container portion 23*d*, which extends outwardly and upwardly from clearance-forming portion 23 for merger with the outermost foot-forming surface 35 leading to cylindrical sidewall 12, is about 0.558 inch and lies at a radius 40*a* from the longitudinal axis 10*a* that is one-half the diameter 40 of the foot support. As noted above, the clearance-forming portion 23 of foot-forming portion 22 provides a clearance distance 24 of 0.375 inch. In such a container, the radius of curvature 36 of the outermost foot-forming surfaces 35 between the cylindrical sidewall 12 and the outwardly and upwardly extending container portions 23*d* formed by radius 38 is about 3.371 inches. As shown in FIG. 6, the generally planar sidewalls 34 of adjacent foot-forming portions 21 lie at an included angle 41 of about 30° and merge with the intervening spherical segments 26 with a radii 26*a* of about 0.148 inches.

Although the invention has been illustrated in the form of a two liter carbonated beverage bottle, the invention may be incorporated into other containers having other capacities.

While a presently known preferred embodiment of the invention has been described above, those skilled in the art will recognize that other embodiments of the invention may be devised within the scope of the following claims.

We claim:

1. A blow molded plastic container for carbonated beverages, comprising an upper mouth-forming portion, a cylindrical sidewall and a lower bottom-forming portion, all about a central longitudinal axis, including a plurality of circumferentially spaced, spherically shaped segments and a plurality of intervening and circumferentially spaced, totally convex, hollow foot-forming portions extending radially from the longitudinal axis of the container and downwardly from the circumferentially spaced, spherically shaped segments, each said foot-forming portion including a bottom clearance-forming portion, each bottom clearance-forming portion including a compound curved offset of a substantial fraction of an inch formed between the longitudinal axis and the container sidewall by opposing equal radii of curvature of a substantial fraction of an inch, said compound curved offset first curving downwardly about a center of curvature below the bottom-forming portion before curving about a center of curvature above the bottom-forming portion.

2. The plastic container of claim 1 wherein each said bottom clearance-forming portion further comprises an uppermost surface curving downwardly and outwardly from the longitudinal axis of the container and merging into the compound curved intermediate offset and a lowermost surface extending downwardly and outwardly from the compound curved offset for formation of a supporting foot.

3. The plastic container of claim 2 wherein each foot-forming portion increases circumferentially in size as it extends radially, and wherein lowermost surface includes a substantially planar portion.

4. The plastic container of claim 1 wherein each compound curved offset contributes almost one-half of the clearance height provided by the bottom clearance-forming portions of the foot-forming portions of the container.

5. The plastic container of claim 1 wherein all internal radii of the hollow foot-forming portions are a substantial fraction of an inch.

6. The plastic container of claim 2 wherein each compound curved offset of each bottom clearance-forming provides a saddle-shaped, distention-resistant transition between the uppermost surface and the lowermost surface.

7. The plastic container of claim 2 wherein the uppermost surface comprises a small concave spherical portion merging into the spherically-shaped segments.

8. The plastic container of claim 2 wherein the outer portion of the lowermost surface merges into an outwardly and upwardly curving surface extending toward the cylindrical sidewall, said outwardly and upwardly curving surface extending from a container supporting foot.

9. The plastic container of claim 3 where each foot-forming portion further comprises substantially planar sidewalls extending downwardly from the spherically-shaped segments and a curved outer transition surface and merging with the cylindrical sidewall.

10. A plastic container comprising a cylindrical sidewall, an upper mouth-forming portion and a bottom portion, all about a central longitudinal axis, said bottom portion further including a plurality of totally convex, hollow foot-forming portions extending radially, circumferentially and downwardly from a central spherical bottom portion to form supporting feet adjacent the periphery of the container, said foot-forming portions comprising saddle-shaped transitions formed with compound curved offsets between the supporting feet and the central spherical bottom portion, said compound curved offsets being formed by opposing substantially equal radii of curvature of a substantial fraction of an inch offsetting said supporting feet substantially downwardly a substantial fraction of an inch.

11. The plastic container of claim 10 wherein said foot-forming portions further comprise substantially-planar portions joined between said saddle-shaped transitions and said supporting feet.

12. The plastic container of claim 10 wherein said saddle-shaped transitions have, in their central planes through the saddle-shaped transitions and coplanar with the longitudinal axis, said compound curved offsets defined by two opposing equal radii of a substantial fraction of an inch, and have, in planes through the saddle-shaped transition and generally parallel with the supporting feet, curved cross-sections, defined by radii extending within the foot-forming portions.

13. In a blow-molded container of flexible plastic material for a carbonated beverage, comprising a cylindrical sidewall merging into a neck and mouth-forming upper portion and into a lower portion including a spherical portion and a plurality of feet, the improvement comprising a plurality of radially-extending, totally convex, hollow foot-forming portions of the lower portion extending from the spherical bottom portion to the plurality of feet, each of said plurality of radially extending, totally convex, hollow, foot-forming portions being defined, in a cross-sectional plane coplanar with the longitudinal axis of the container and the center of the hollow, foot-forming portion, by:

a slightly downwardly curved, central portion centered on the longitudinal axis, a compound-curved, downwardly offset portion formed with opposing equal radii of curvature of a substantial fraction of an inch, an outermost, linear, slightly descending portion extending outwardly from the compound curved offset portion, and an outer curved portion forming a foot and extending upwardly and outwardly from the outermost linear, slightly descending portion for merger with the container sidewall, said foot-forming portion providing a substantial clearance distance between the central portion and foot, resistance against distention of the central portion beyond the foot and substantial freedom from stress concentrations.

14. The improvement of claim 13 wherein each said foot-forming portion further comprises a pair of generally planar sidewalls merging into the spherical container bottom with curved portions having cross-sectional radii of curvature of a substantial fraction of an inch.

15. In a plastic container comprising a mouth-forming upper portion, a cylindrical sidewall and a base-forming bottom portion comprising a central portion and a plurality of hollow feet formed about the central portion, the improvement wherein each of said plurality of hollow feet is formed by a totally convex, radially, circumferentially and downwardly extending bottom portion comprising a saddle-shaped, deflection-resisting transition, defined by an external radius of a substantial fraction of an inch, extending radially, circumferentially and downwardly from said central portion and merging into an outwardly curving transition, defined by a substantially equal internal radius of a substantive fraction of an inch, leading to a substantially planar portion extending radially, circumferentially and slightly downwardly to one of the feet, said saddle-shaped, deflection-resisting transition and slightly downwardly extending planar portion providing clearance of a substantial fraction of an inch between the central bottom portion and feet.

16. The improvement of claim 15 wherein the plurality of totally convex, radially, circumferentially and downwardly extending bottom portions comprise only curved portions having internal radii of curvature of at least a substantial fraction of an inch.

17. A blow molded plastic base for a container comprising a plurality of downwardly extending circumferentially spaced, spherically shaped segments and a plurality of intervening and circumferentially spaced, hollow foot-forming portions, all extending radially outwardly from the central longitudinal axis of the base, said hollow foot-forming portions extending downwardly from the circumferentially spaced, spherically shaped segments, and including bottom clearance-forming portions, each bottom clearance-forming portion including a compound curved offsetting transition being formed, in a cross-sectional plane through the compound curved offsetting transition and coplanar with the central longitudinal axis, by a pair of opposing equal radii of a substantial fraction of an inch, and, in cross-sectional planes crossing the compound curved offsetting transition and the longitudinal axis and generally parallel to the hollow foot-forming portions, by curves formed by internal radii extending within the foot-forming portions.

18. The base of claim 17 wherein each of the hollow foot-forming portions includes a substantially planar portion extending outwardly and circumferentially from the compound curved offsetting transition.

19. The base of claim 18 wherein each of the hollow foot-forming portions includes a pair of substantially planar sidewall portions joined with the circumferentially extending sides of the substantially planar portion with curved transitions having internal radii of a substantial fraction of an inch.

20. The base of claim 17 wherein the clearance forming portions of the hollow foot-forming portions provide a clearance of a substantial fraction of an inch at the central longitudinal axis.

21. A base of a container as recited in claim 18 wherein said clearance-forming portions merge into a slightly concave spherical center portion formed about the central longitudinal axis.

22. A plastic container for carbonated beverages comprising:

a cylindrical sidewall merging into a neck and mouth-forming upper portion and into a bottom including by a convex spherical portion and a plurality container supporting feet, said plurality of container supporting feet being formed by totally convex, hollow foot-forming portions extending downwardly from said convex spherical portion, each said totally convex, hollow foot-forming portion comprising an outer substantially planar portion being joined with the bottom portion by an inwardly extending, deflection-resisting, saddle-like transition and a pair of substantially planar side portions and to the cylindrical sidewall by a cylindrical outer portion having a large radius of curvature, each said inwardly extending, deflection-resisting saddle-like transition providing a downward offset of said substantially planar portion and a substantial portion of the clearance between the spherical bottom portion and the container supporting feet, each said deflection-resisting saddle-like transition being formed and merged with said substantially planar portion by a compound curved transition extending upwardly and inwardly from said substantially planar portion and being formed by opposing equal radii of curvature of at least a substantial fraction of an inch.

23. The container of claim 22 wherein said pair of substantially planar side panels merge into said convex spherical bottom portion with a minimum external radii of curvature of a substantial fraction of an inch.

* * * * *